US006993870B2

(12) United States Patent
McDonald et al.

(10) Patent No.: US 6,993,870 B2
(45) Date of Patent: Feb. 7, 2006

(54) RAIN GUTTER GUARD AND METHOD

(75) Inventors: Thomas A. McDonald, Grand Rapids, MI (US); Tony A. Cobb, Wyoming, MI (US)

(73) Assignee: Quality Edge, Inc., Walker, MI (US)

( * ) Notice: Subject to any disclaimer, the term of this patent is extended or adjusted under 35 U.S.C. 154(b) by 71 days.

(21) Appl. No.: 10/458,562

(22) Filed: Jun. 10, 2003

(65) Prior Publication Data

US 2004/0250478 A1 Dec. 16, 2004

(51) Int. Cl.
*E04D 13/00* (2006.01)

(52) U.S. Cl. ..... 52/11; 52/12; 52/14; 52/15

(58) Field of Classification Search ..... 52/11, 52/12, 14, 15; 248/48.1, 48.2, 221.4
See application file for complete search history.

(56) References Cited

U.S. PATENT DOCUMENTS

| | | | |
|---|---|---|---|
| 836,012 | A | 11/1906 | Cassen |
| 891,405 | A | 6/1908 | Cassens |
| 891,406 | A | 6/1908 | Cassens |
| 2,669,950 | A | 2/1954 | Bartholomew |
| 2,672,832 | A | 3/1954 | Goetz |
| 3,388,555 | A | 6/1968 | Foster |
| 4,404,775 | A | 9/1983 | Demartini |
| 4,435,925 | A | 3/1984 | Jefferys |
| 4,493,588 | A | 1/1985 | Duffy |
| 4,497,146 | A | 2/1985 | Demartini |
| 4,757,649 | A | 7/1988 | Vahldieck |
| 4,796,390 | A | 1/1989 | Demartini |
| 5,016,404 | A | 5/1991 | Briggs |
| 5,181,350 | A | 1/1993 | Meckstroth |
| 5,189,849 | A | 3/1993 | Collins |
| 5,305,562 | A | 4/1994 | Sapia |
| 5,375,379 | A | 12/1994 | Meckstroth |
| 5,388,377 | A | 2/1995 | Faulkner |
| 5,406,755 | A | 4/1995 | Serano |
| 5,457,916 | A | 10/1995 | Tenute |
| 5,459,965 | A | 10/1995 | Meckstroth |
| 5,471,798 | A | 12/1995 | Kuhns |
| 5,491,998 | A | 2/1996 | Hansen |
| 5,495,694 | A | 3/1996 | Kuhns |
| 5,575,118 | A | 11/1996 | Vahldieck |
| 5,617,678 | A | 4/1997 | Morandin et al. |
| 5,640,809 | A | 6/1997 | Iannelli |
| 5,737,879 | A | 4/1998 | Sweet |
| 5,819,476 | A | 10/1998 | Annestedt, Sr. |
| 5,845,435 | A | 12/1998 | Knudson |
| 5,878,533 | A | 3/1999 | Swanfeld, Jr. |
| 5,911,659 | A | 6/1999 | Serano |
| 6,016,631 | A | 1/2000 | Lowrie, III |
| 6,073,398 | A | 6/2000 | Williams |
| 6,098,345 | A | 8/2000 | Demartini et al. |

(Continued)

*Primary Examiner*—Carl D. Friedman
*Assistant Examiner*—Chi Q. Nguyen
(74) *Attorney, Agent, or Firm*—Price, Heneveld, Cooper, DeWitt & Litton, LLP

(57) ABSTRACT

A guard and associated method for rain gutters includes a cap or deflector extending over a gutter of the type having a trough-shaped interior, a rear wall extending along a roof fascia, and a front lip with a channel and an end flange. A mounting bracket has a rear portion abutting the rear wall of the gutter, an upper portion supporting the deflector, and a front portion with a hook-shaped nose. The mounting bracket nose is configured for insertion under the end flange of the gutter, such that the mounting bracket is rotated rearwardly along a generally vertical arc about the nose toward the rear wall of the gutter, and shifted laterally into a skewed orientation within the gutter interior. The mounting bracket is then pivoted laterally along a generally horizontal plane about the nose into a perpendicular orientation within the gutter interior to retain the nose in the front lip of the gutter, and facilitate attachment of the rear portion of the mounting bracket to the rear wall of the gutter and the roof fascia.

67 Claims, 8 Drawing Sheets

U.S. PATENT DOCUMENTS

| | | | | | |
|---|---|---|---|---|---|
| 6,151,836 | A | | 11/2000 | McGlothlin et al. | |
| 6,182,399 | B1 | | 2/2001 | Pollera | |
| 6,269,592 | B1 | | 8/2001 | Rutter | |
| 6,367,743 | B1 | | 4/2002 | Iannelli | |
| 6,412,228 | B1 | | 7/2002 | Meckstroth | |
| 6,453,622 | B1 | | 9/2002 | Walters | |
| 6,470,628 | B1 | | 10/2002 | Walters | |
| 6,658,796 | B1 | * | 12/2003 | Higgins | 52/11 |
| 6,732,477 | B1 | * | 5/2004 | Richard | 52/12 |
| 2002/0069594 | A1 | | 6/2002 | Sweet | |
| 2002/0073631 | A1 | | 6/2002 | Baker | |
| 2003/0009951 | A1 | * | 1/2003 | Bergeron | 52/12 |

* cited by examiner

RAIN GUTTER GUARD AND METHOD

BACKGROUND OF THE INVENTION

The present invention relates to rain gutters for buildings and the like, and in particular to a guard and associated method to prevent leaves, twigs and other debris from entering the interior of the gutter.

Gutter protection systems, such as guards, caps, screens and shields, are well known in the art, and are designed to prevent leaves and other debris from entering the trough-shaped interior of the gutter, while directing runoff water to a desired location. Some types of gutter guards, such as those disclosed in U.S. Pat. Nos. 6,182,399 and 5,845,435, are incorporated into a complete gutter system of the type having a special gutter shape. Consequently, such guards cannot be used to retrofit an existing conventional gutter.

Some types of gutter guards, such as that disclosed in U.S. Patent Publication 2002/0073631 A1, attach to the existing hangers of a conventional gutter, while others, such as that disclosed in U.S. Patent Publication No. 2002/0069594 A1, employ special clips to attach the guard to the front lip of an existing gutter. In both such designs, extra strain is applied to the gutter and/or associated hangers as a result of the weight of the guard, as well as the runoff water and related debris. This additional weight can result in substantial problems, particularly when the existing gutter is installed without anticipating the additional weight of a retrofitted guard.

Many types of gutter guards are currently available, including those that use screens or expanded metal panels, as well as those using imperforate caps or top sheets. Typically, both of these designs rely upon the rain gutter itself for support, and/or must be fastened to the roof, resulting in increased installation difficulty and cost.

SUMMARY OF THE INVENTION

One aspect of the present invention is to provide a guard for rain gutters and the like of the type having a generally trough-shaped interior, a rear wall extending along a roof fascia, and a front lip with a channel and an end flange. The guard includes a cap having a rearward portion shaped to extend along an associated roof, a medial portion shaped to extend over the interior of the gutter, and a forward portion shaped to extend adjacent to the front lip of the gutter. The guard also includes a mounting bracket having a rearward portion adapted for abutment with the rear wall of the gutter, an upper portion supporting the cap to deflect debris from the interior of the gutter, and a forward portion having a hook-shaped nose configured for insertion under the end flange of the gutter, such that the mounting bracket is rotated rearwardly along a generally vertical arc about the nose toward the rear wall of the gutter, and shifted laterally into a skewed orientation within the interior of the gutter, and subsequently pivoted laterally along a generally horizontal plane about the nose into a generally perpendicular orientation within the interior of the gutter to retain the nose in the channel of the gutter, and facilitate attachment of the rear portion of the mounting bracket to the rear wall of the gutter and the roof fascia.

Another aspect of the present invention is to provide a mounting bracket for rain gutter guards of the type having a deflector extending over a gutter with a generally trough-shaped interior, a rear wall extending along a roof fascia, and a front lip with a channel and an end flange. The mounting bracket includes a rearward portion adapted for abutment with the rear wall of the gutter, an upper portion shaped for supporting the deflector to deflect debris from the interior of the gutter, and a forward portion having a hook-shaped nose configured for insertion under the end edge of the gutter, such that the mounting bracket is rotated rearwardly along a generally vertical arc about the nose toward the rear wall of the gutter, and shifted laterally into a skewed orientation within the interior of the gutter to positively capture the nose in the channel of the gutter, and subsequently pivoted laterally along a generally horizontal plane about the nose into a generally perpendicular orientation within the interior of the gutter to retain the nose in the channel of the gutter, and facilitate attachment of the rearward portion of the mounting bracket to the rear wall of the gutter and the roof fascia.

Yet another aspect of the present invention is to provide a guard for rain gutters and the like of the type having a generally trough-shaped interior, a rear wall extending along a roof fascia, and a front lip with a channel and an end flange. The guard includes an imperforate cap having a rearward portion shaped to extend along an associated roof, a medial portion shaped to extend over the interior of the gutter, and a curved forward portion shaped to extend above and forward of the front lip of the gutter to define a gap of predetermined width through which rainwater is swept into the interior of the gutter. The guard also includes a mounting bracket having a rearward portion thereof adapted for abutment with the rear wall of the gutter, an upper portion thereof supporting the cap to deflect debris from the interior of the gutter, and a forward portion thereof having a hook-shaped nose configured for insertion under the end flange of the gutter such that the mounting bracket assumes a generally perpendicular orientation within the interior of the gutter to retain the nose in the channel of the gutter, and facilitate attachment of the rearward portion of the mounting bracket to the rear wall of the gutter and the roof fascia, so as to precisely maintain the predetermined width of the gap during use.

Yet another aspect of the present invention is a method for deflecting debris and the like from rain gutters of the type having a generally trough-shaped interior, a rear wall extending along a roof fascia, and a front lip with a channel and an end flange. The method comprises providing a cap having a rearward portion shaped to extend along an associated roof, a medial portion shaped to extend over the interior of the gutter, and a forward portion shaped to extend adjacent to the front lip of the gutter. A mounting bracket is provided having a rearward portion shaped for abutment with the rear wall of the gutter, an upper portion shaped to support the cap to deflect debris from the interior of the gutter, and a forward portion having a hook-shaped nose. The method further includes inserting the nose of the mounting bracket under the end edge of the gutter, and rotating the mounting bracket rearwardly and laterally along a generally vertical arc about the nose toward the rear wall of the gutter into a skewed orientation within the interior of the gutter. The mounting bracket is then pivoted along a generally horizontal plane about the nose into a generally perpendicular orientation within the interior of the gutter to retain the nose in the channel of the gutter. The rearward portion of the mounting bracket is then attached to the rear wall of the gutter and the roof fascia.

Yet another aspect of the present invention provides a self-supporting gutter guard that can be easily and quickly attached to an existing rain gutter. A unique mounting bracket shifts into the interior of the gutter in a quick and easy fashion, and includes self-leveling and aligning features which automatically locate the same properly within the gutter interior to ensure secure support and proper debris deflection. The mounting bracket is preferably configured to be mounted on the roof fascia by a single fastener to expedite installation.

In one embodiment of the present invention, the guard is anchored solely through the roof fascia, and does not penetrate or damage the roof shingles. Furthermore, when an imperforate cap type deflector is used, the unique mounting bracket precisely retains the cap in a predetermined edge forward relationship with the gutter that maintains a consistent gap which keeps out debris and animals, such as rodents, birds, etc., without restricting the flow of rainwater into the gutter. The mounting bracket has a very strong, rigid design to resist damage to the guard by tree branches and the like. Preferably, the cap has a very durable finish that can be matched to the appearance of the building.

The gutter guard is economical to manufacture, easy to install and repair, and can be readily retrofitted to an existing conventional gutter. The gutter guard is capable of a long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 2:
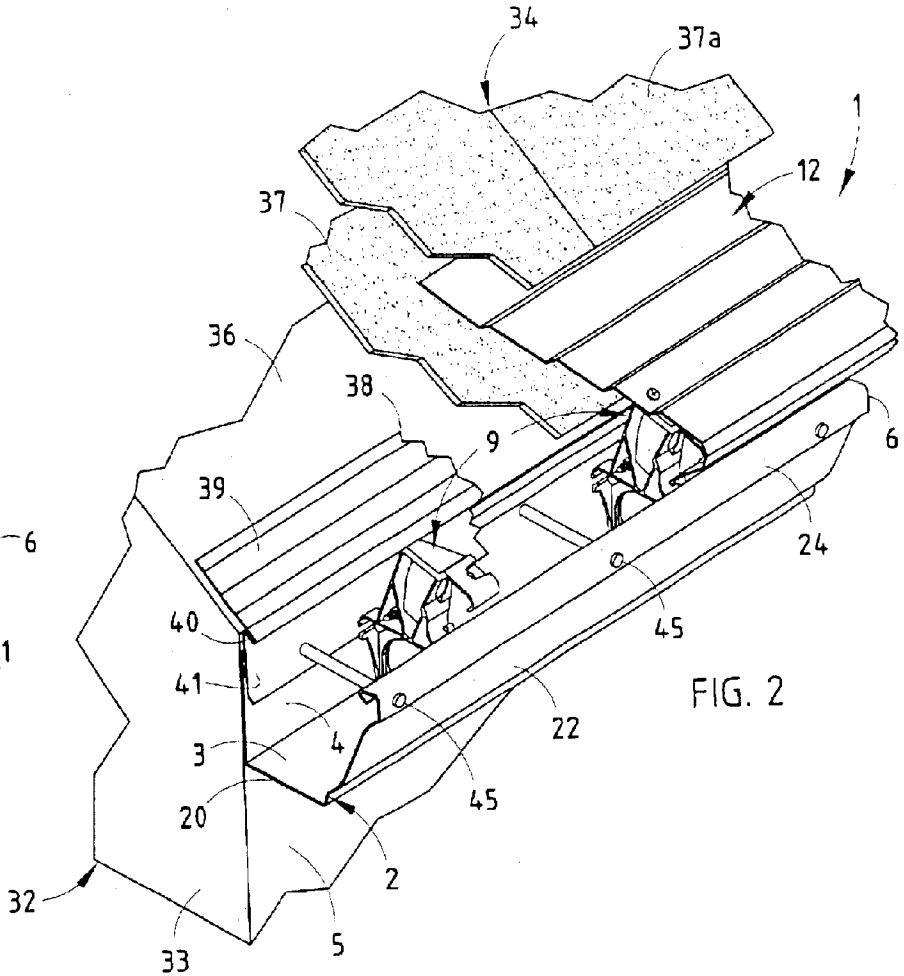
FIG. 2 is a fragmentary perspective view of the rain gutter guard shown installed over the gutter along an associated building roof, wherein portions thereof have been broken away to reveal internal construction.
Figure 13:
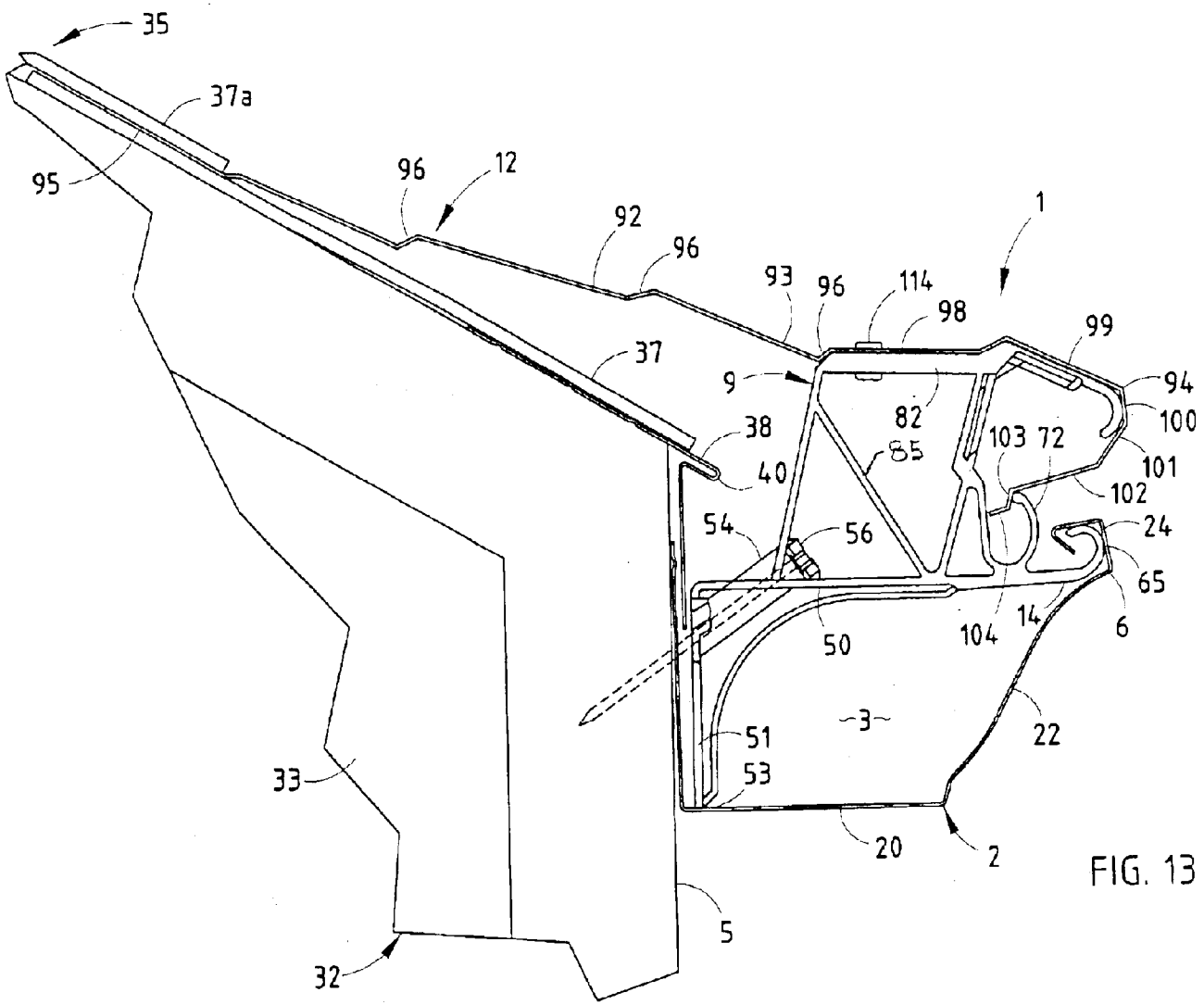
FIG. 13 is a side elevational view of the mounting bracket, gutter and cap shown in FIG. 12, wherein the cap has been shifted to a fully installed position.

For purposes of description herein, the terms "upper", "lower", "right", "left", "rear", "front", "vertical", "horizontal" and derivatives thereof shall relate to the invention as oriented in FIGS. 2 and 13. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limited, unless the claims expressly state otherwise.

Figure 9:
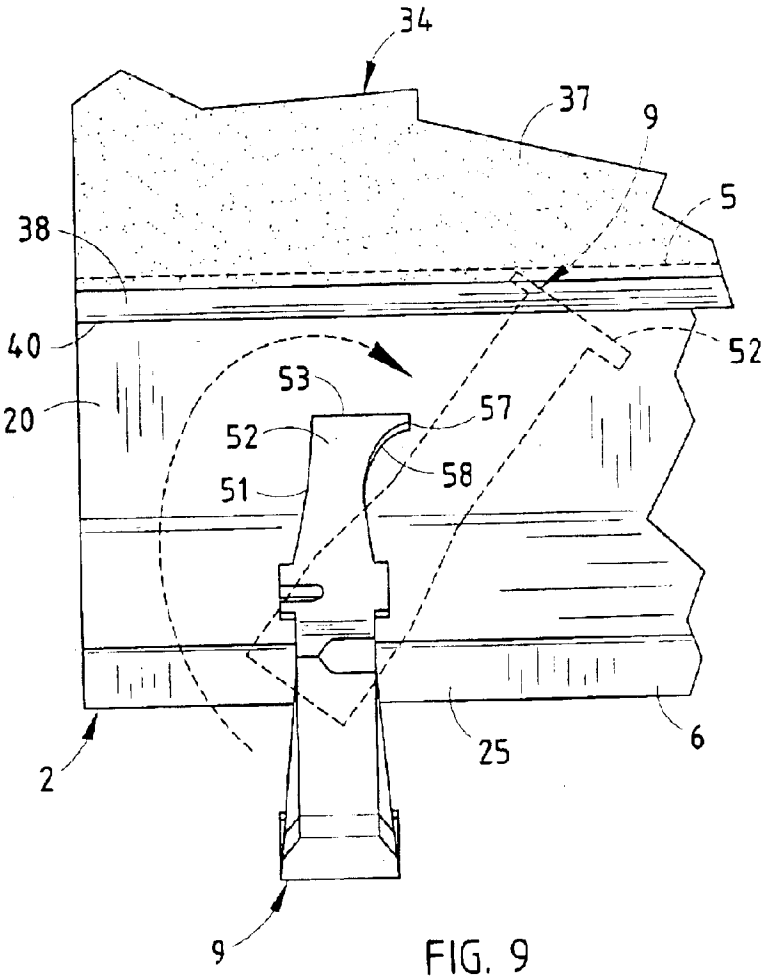
FIG. 9 is a top plan view of the mounting bracket and gutter shown in FIG. 8, wherein broken lines illustrate the mounting bracket being shifted into a skewed, partially installed position within the interior of the gutter.
Figure 9A:
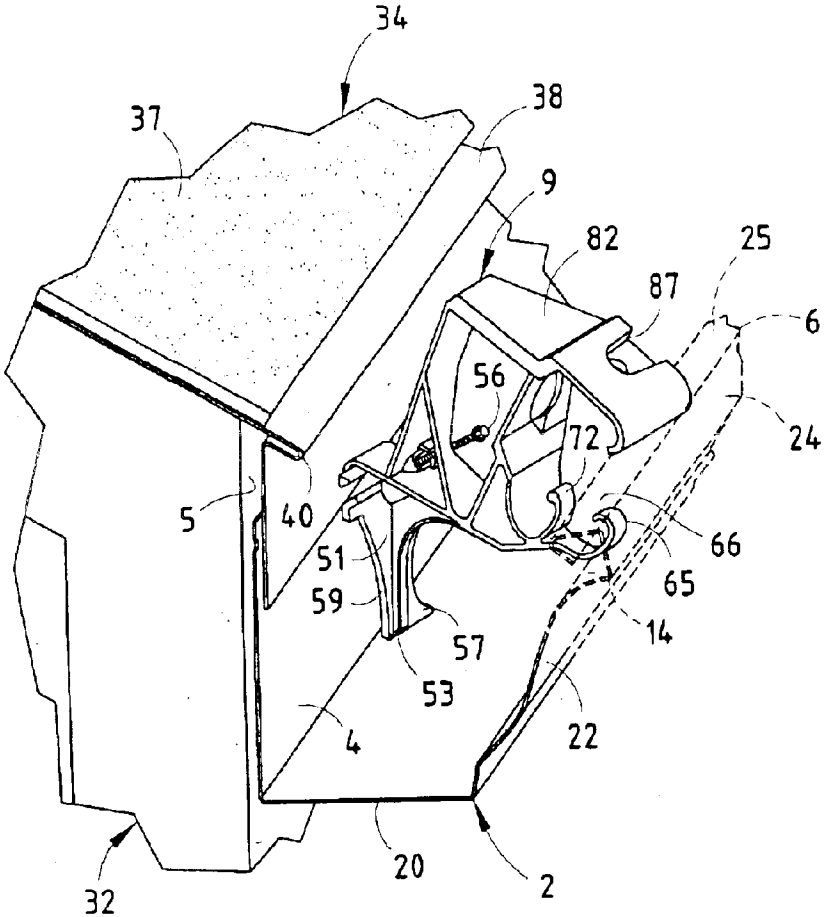
FIG. 9A is a perspective view of the mounting bracket and gutter, as shown in the skewed, partially installed position.

The reference numeral 1 (FIGS. 1 and 2) generally designates a guard for rain gutters 2 of the type having a trough-shaped interior 3, a rear wall 4 extending along an associated roof fascia 5 and a front lip 6 with a channel 7 and an end flange 8. A plurality of mounting brackets 9 are provided, wherein each has a rear portion 10 abutting the rear wall 4 of gutter 2, an upper portion 11 supporting an associated deflector, such as the illustrated cap 12, and a forward portion 13 having a hook-shaped nose 14. The nose 14 of mounting bracket 9 is configured to be inserted under the end flange 8 of gutter 2, such that mounting bracket 9 is rotated rearwardly and laterally along a generally vertical arc about nose 14 toward the rear wall 4 of gutter 2 into a skewed orientation within the gutter interior 3, as shown in FIGS. 9 and 9A. Mounting bracket 9 is then pivoted laterally along a generally horizontal plane about nose 14, as shown in FIG. 10, into a perpendicular orientation within gutter interior 3 to retain nose 14 in the front lip 6 of gutter 2, and facilitate attachment of the rear portion 10 of mounting bracket 9 to the rear wall 4 of gutter 2 and the associated roof fascia 5.

In the illustrated example, guard 1 (FIGS. 1 and 2) is shown in conjunction with a conventional style rain gutter 2, having a flat bottom wall 20 which joins with rear wall 4 in a substantially perpendicular orientation. The illustrated gutter 2 also includes a forward wall 21 having a curved medial portion 22 with front lip 6 extending along the upper portion thereof. A ledge 23 connects the lower edge of medial portion 22 with the forward edge of bottom wall 20. Medial portion 22 presents an ornamental cove appearance to gutter 2. The illustrated front lip 6 includes a generally vertical leg 24 and a generally horizontal leg 25 which terminates at end flange 8. End flange 8 is turned outwardly away from rear wall 4, and protrudes downwardly at an angle of approximately 30–50 degrees from the horizontal leg 25 of front lip 6. The rear wall 4 of the illustrated gutter 2 includes an inwardly protruding, rounded bead 26 disposed adjacent the uppermost edge 27 of rear wall 4. The upper edge 27 of rear wall 4 is generally coplanar with the horizontal leg 25 of front lip 6. Gutter 2 may be constructed from any suitable material, such as plastic, steel, or the illustrated formed sheet aluminum.

The illustrated guard 1 (FIGS. 1 and 2) is shown attached to a conventional residential building 32 of the type having an end wall 33, and a roof 35, with fascia 5 extending along one side thereof. Roof 35 has a substantially conventional construction, comprising sheets of rigid underlay material 36, such as plywood, particleboard or the like, over which roofing materials, such as the illustrated shingles 37, are attached. In the illustrated example, a drip edge 38 is shown attached along the free edge of roof 35 and is designed to prevent moisture from seeping into the roof underlay 36. The illustrated drip edge 38 has an angled upper flange 39 which conforms with the pitch of roof 35, and extends to a protruding edge 40. Drip edge 38 is reverse bent back from edge 40 to a generally vertical flange 41 that is positioned over the rear wall 4 of gutter 2.

Figure 1:
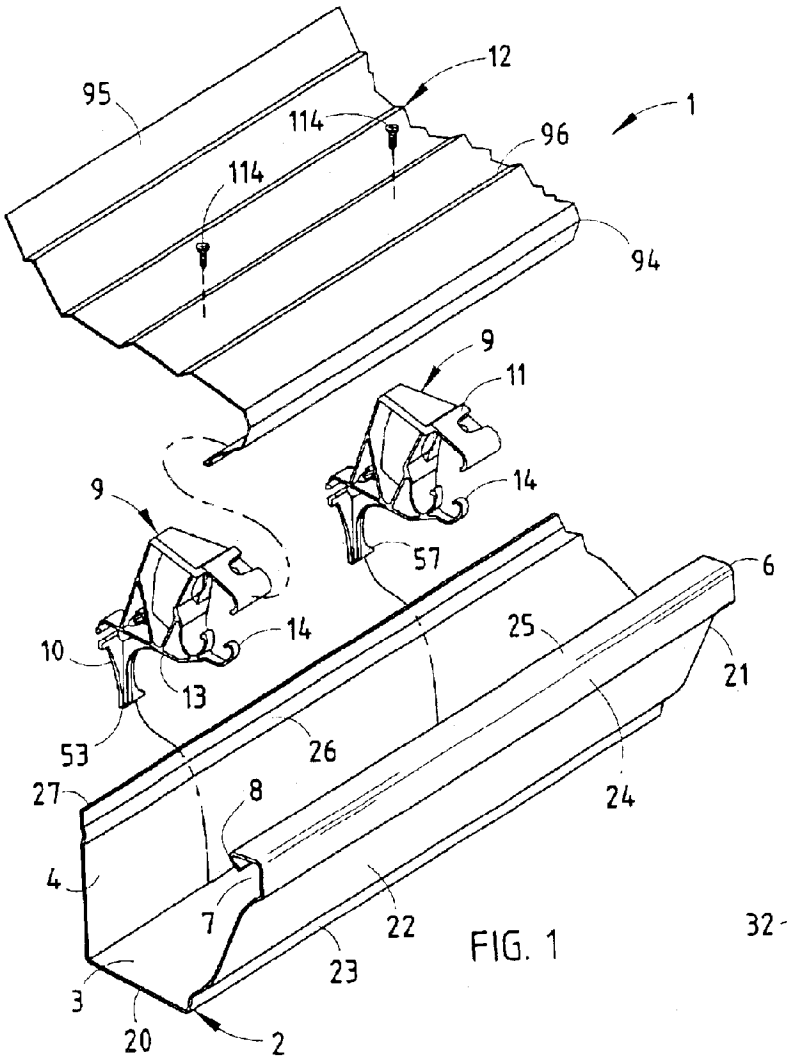
FIG. 1 is an exploded perspective view of a rain gutter guard embodying the present invention shown in conjunction with a conventional rain gutter.
Figure 3:
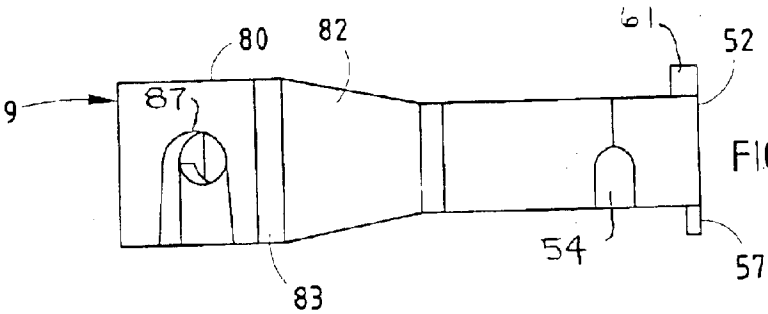
FIG. 3 is a top plan view of a mounting bracket portion of the present invention.
Figure 4A:
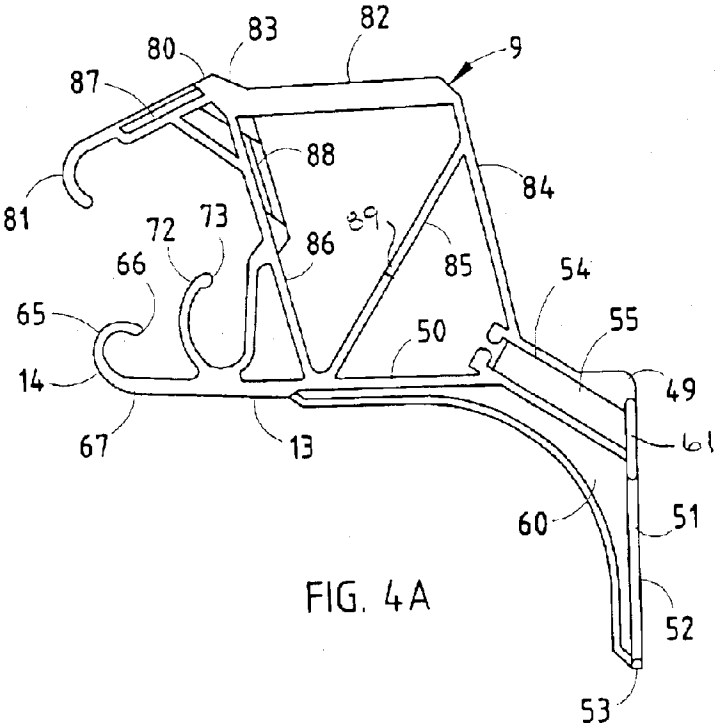
FIG. 4A is a right-hand side elevational view of the mounting bracket.
Figure 4:
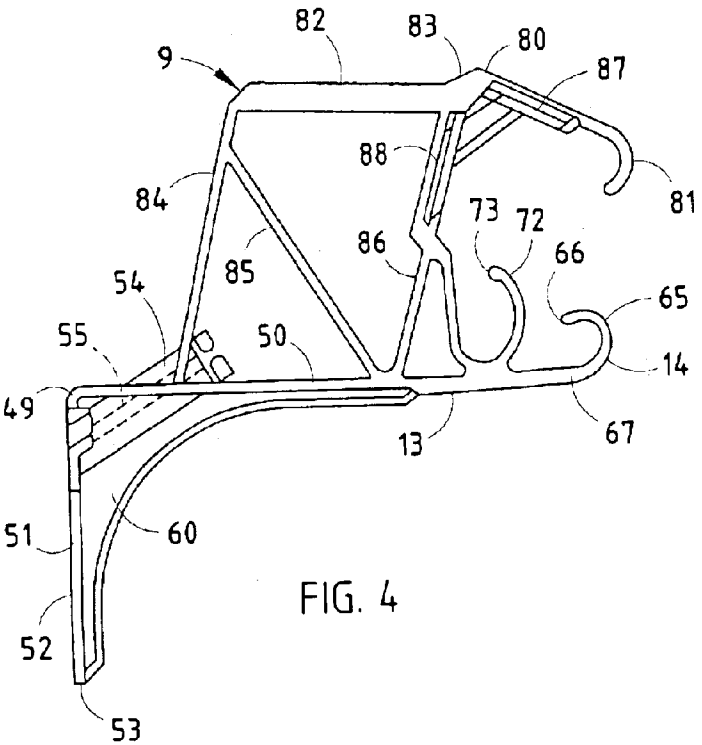
FIG. 4 is a left-hand side elevational view of the mounting bracketing.
Figure 10:
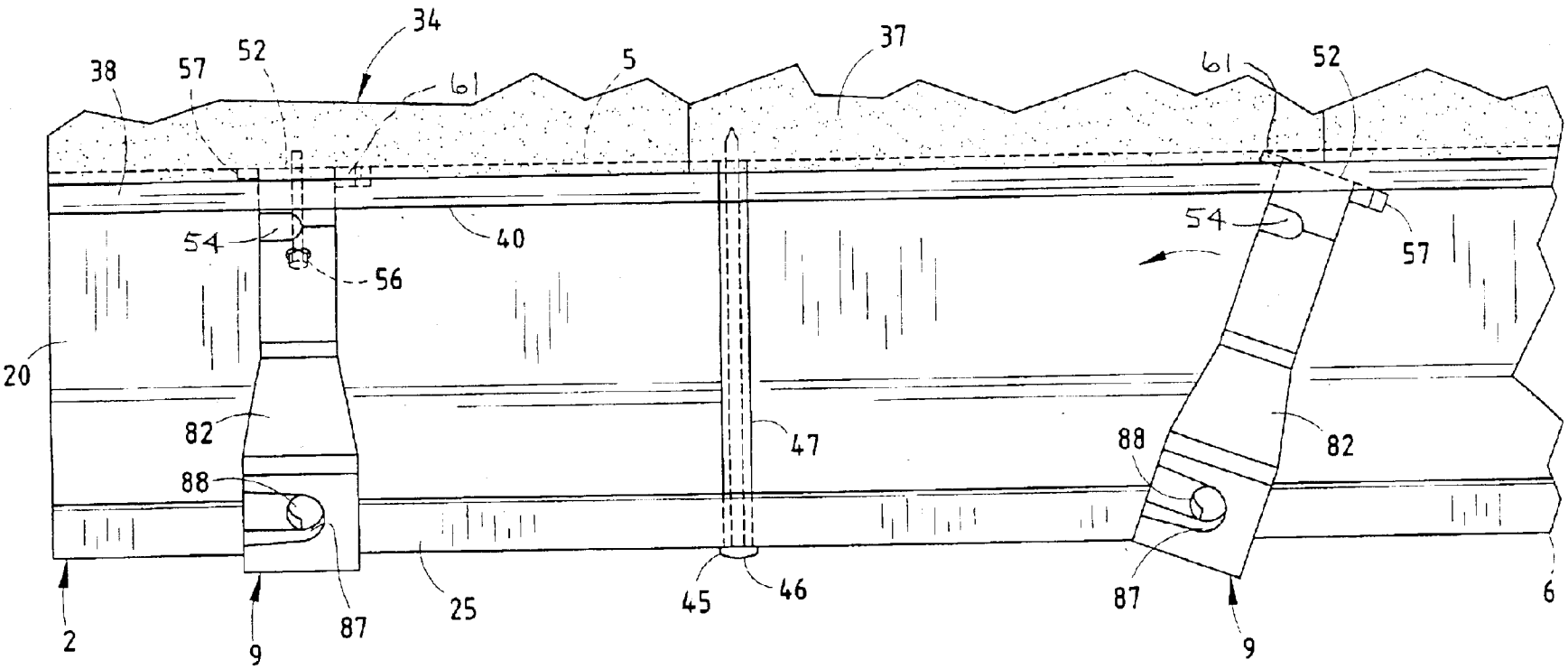
FIG. 10 is a top plan view of two mounting brackets and the associated gutter, the left-hand mounting bracket being shown in a fully installed position within the gutter, and the right-hand mounting bracket being shown in the skewed, partially installed condition within the interior of the gutter.

The illustrated existing gutter 2 is attached to building 32 in a conventional fashion, which as best illustrated in FIGS. 1 and 10, includes a plurality of hangers 45 which are in the form of nails 46 that are driven through the vertical leg 24 of front lip 6, through the rear wall 4 of gutter 2 and into the roof fascia 5. Nails 46 are received through a cylindrically-shaped collar or stretcher 47 which is positioned between the front lip 6 and rear wall 4 of gutter 2 to retain the trough shape of interior 3. Hangers 45 are spaced apart along the length of gutter 2 in a manner to support the weight of the same, as well as the associated rainwater.

Figure 6:
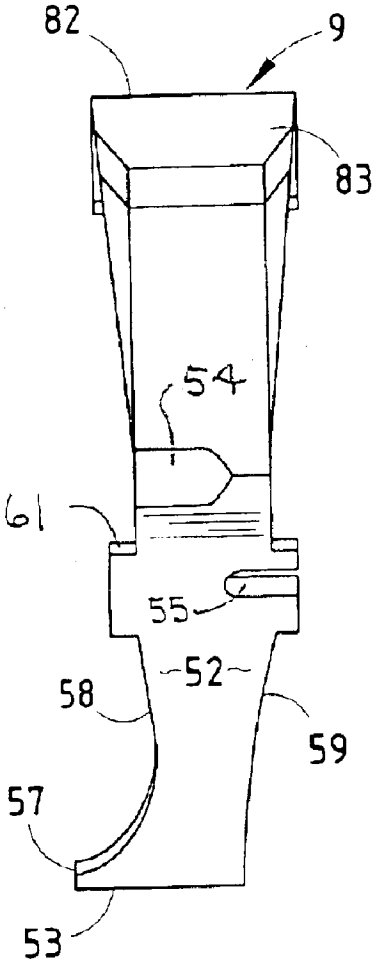
FIG. 6 is a rear elevational view of the mounting bracket.
Figure 5:
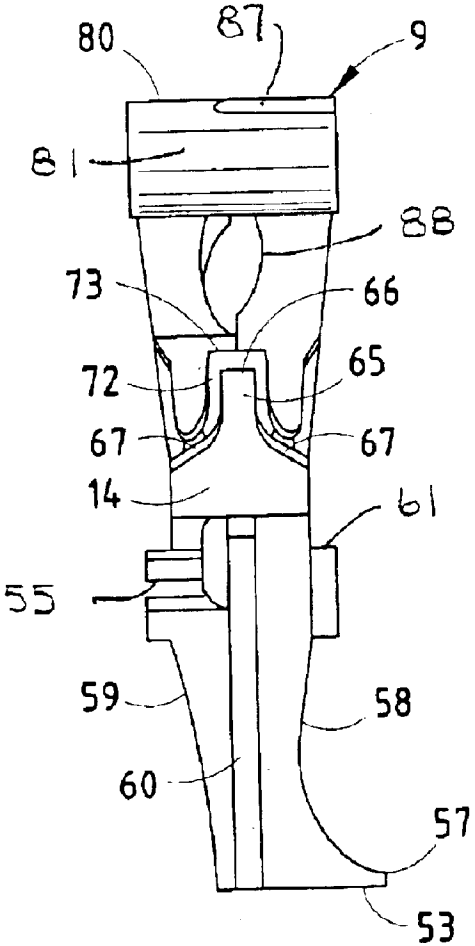
FIG. 5 is a front elevational view of the mounting bracket.
Figure 11:
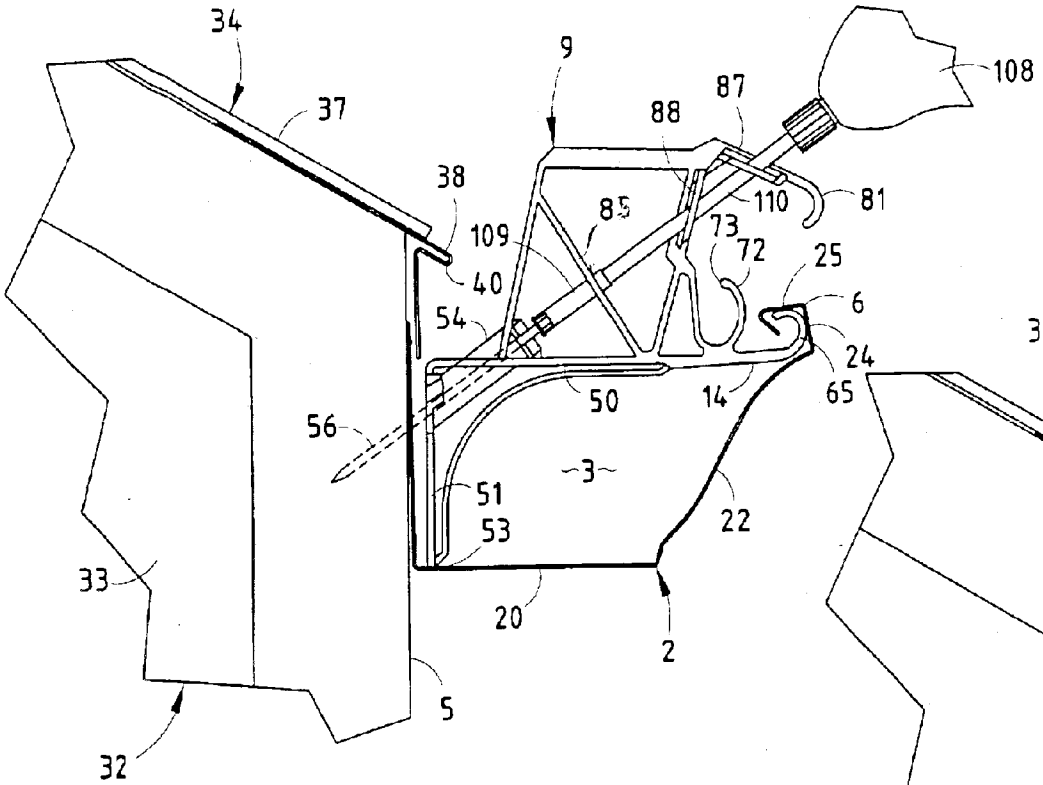
FIG. 11 is a side elevational view of the mounting bracket and gutter shown being attached to an associated roof fascia.

With reference to FIGS. 3–6, the illustrated mounting bracket 9 has a molded one-piece construction, and may be made from a relatively rigid, synthetic resin material, such as plastic or the like, to provide a very strong, lightweight unit. Mounting bracket 9 includes a generally L-shaped member 49 with a horizontal leg 50, and a vertical leg 51 that defines the rear portion 10 of mounting bracket 9. Vertical leg 51 includes a generally flat rear surface 52 configured to abut the rear wall 4 of gutter 2 in a flush relationship to positively position mounting bracket 9 in a perpendicular orientation within the gutter interior 3. The vertical leg 51 of mounting bracket 9 also includes a generally flat bottom edge 53 that is configured to abut the bottom of wall 20 of gutter 2 in a flush relationship to positively position mounting bracket 9 vertically within gutter interior 3. A fastener boss 54, having a generally semi-cylindrical shape, extends between the horizontal leg 50 and vertical leg 51 of mounting bracket 9, and includes a central aperture 55 in which a threaded fastener 56 (FIGS. 11 and 12) is received. Fastener boss 54 is disposed at a predetermined angle in the nature of 50–70 degrees from the vertical to facilitate installation, as described in greater detail below. The vertical leg 51 of mounting bracket 9 includes an arm 57 which extends laterally from bottom edge 53 and is designed for abuttingly engaging the bottom wall 20 of gutter 2 to resist rotation of mounting bracket 9 during installation of fastener 56. In the illustrated example, as viewed in FIG. 5, the right-hand side edge 58 of vertical leg 51 tapers inwardly from horizontal leg 50, and then curves outwardly to meet the end of arm 57. In contrast, the opposite side edge 59 of vertical leg 51 tapers directly from horizontal leg 50 to bottom edge 53. An arcuate gusset 60, having a T-shaped cross-sectional shape, extends between horizontal leg 50 and vertical leg 51 to provide additional rigidity to mounting bracket 9. As best illustrated in FIGS. 5 and 6, the illustrated mounting bracket 9 also includes a laterally extending wing portion 61 protruding from opposite sides of vertical leg 51, flush with rear surface 52, which functions like a T-square to assist in precisely locating mounting bracket 9 in a perpendicular orientation within gutter 2.

In the illustrated example, nose 14 (FIGS. 3–6) is hook-shaped, and located at the free or terminal end of horizontal leg 50 on mounting bracket 9. Nose 14 curves inwardly in a generally C-shaped fashion, and includes outermost portion 65 and a free edge 66. As best illustrated in FIG. 5, nose 14 has a predetermined width which tapers inwardly to free edge 66 to facilitate rotation of mounting bracket 9 into perpendicular orientation within gutter interior 3, without distorting the front lip 6 of gutter 2. More specifically, the opposite side edges 67 of nose 14 taper inwardly along curved lines to free edge 66, which is generally linear in shape.

The horizontal leg 50 (FIGS. 3–6) of mounting bracket 9 also includes a hook-shaped cap retainer 72, which is spaced inwardly from nose 14, and curves upwardly to a free edge 73, which is spaced above the free edge 66 of nose 14. Cap retainer 72 has a generally curved C-shaped configuration that is somewhat wider than the curved configuration of nose 14, and is adapted to retain cap 12 in the manner described in greater detail below.

Mounting bracket 9 (FIGS. 3–6) also includes an inclined top member 80 which is connected with and disposed generally above L-shaped member 49, and defines the upper portion 11 of mounting bracket 9. The illustrated top member 80 includes a downwardly curved front edge 81 that is configured to support the forward portion of cap 12. Top member 80 also includes a generally planar rear portion 82 which extends in a generally horizontal relationship with horizontal leg 50. The rear portion 82 of top member 80 extends forwardly to an angled ledge 83, which also serves to connect cap 12 with mounting bracket 9. Angled flanges 84–86 connect top member 80 with L-shaped member 49 in a vertically spaced apart relationship. As best illustrated in FIGS. 3–6, top member 80 and angled flange 86 include access apertures 87–88 respectively to facilitate installation of fastener 56 in the manner described below. The right-hand side edge 89 of flange 85 is V-shaped, with the vertex positioned in line with apertures 87 and 88 to provide clearance for fastener 56.

Figure 12:
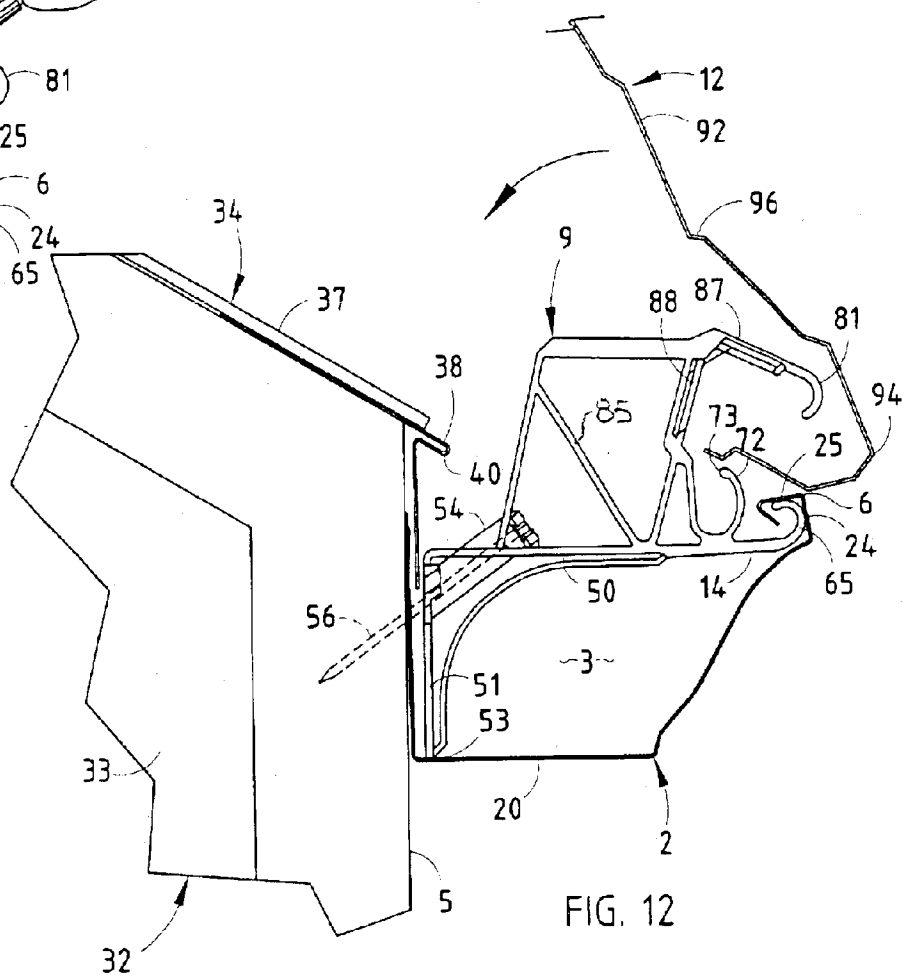
FIG. 12 is a side elevational view of the mounting bracket and gutter shown in FIG. 11, with a cap portion of the guard being positioned for installation.

With reference to FIGS. 12 and 13, the illustrated leaf/debris deflector is in the nature of an imperforate cap 12 having a rearward portion 92 extending along roof 35, a medial portion 93 extending over the interior 3 of gutter 2, and a forward portion 94 extending adjacent to the front lip 6 of gutter 2. The illustrated cap 12 is formed from a relatively thin, substantially rigid sheet of metal, plastic or the like, and is inclined downwardly at a predetermined angle. The rearwardmost section 95 of cap 12 has a flat planar shape that is adapted to be inserted between the first and second courses of shingles 37 and 37*a* respectively on building roof 35 to retain the same in place without nails or other fasteners. The area of cap 12 between rear section 95 and forward portion 94 has a stepped configuration, with ridges 96, that provides additional rigidity to cap 12. A generally horizontal section 98 overlies the rear area 82 of mounting bracket 9, as shown in FIG. 13. The forward portion 94 of cap 12 is inwardly turned with a generally C-shaped configuration, and is positioned forwardly of the front lip 6 of gutter 2 to sweep water into the interior 3 of gutter 2, while deflecting debris onto the ground. More specifically, the forward portion 94 of cap 12 includes angled flanges 99–101 which generally mate with the curved front edge 81 of top member 80 on mounting bracket 9, as well as flanges 102–104, which intersect to define a ledge into which the free edge 73 of cap retainer 72 is received to connect the forward portion 94 of cap 12 with mounting bracket 9.

As will be appreciated by those skilled in the art, mounting bracket 9 may be used to support a wide variety of different types of gutter guards, including perforated styles, such as screens, expanded metal panels, etc., as well as imperforate styles, such as the illustrated nose-forward design.

Figure 8:
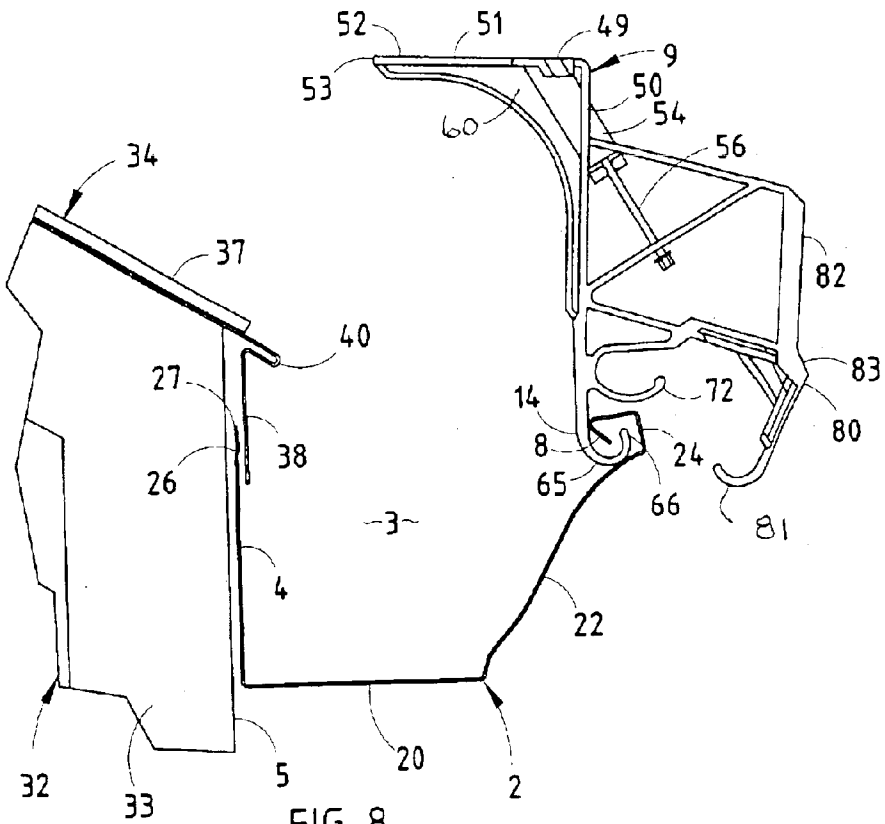
FIG. 8 is a side elevational view of the mounting bracket shown with the nose snapped over the end flange of the gutter.
Figure 7:
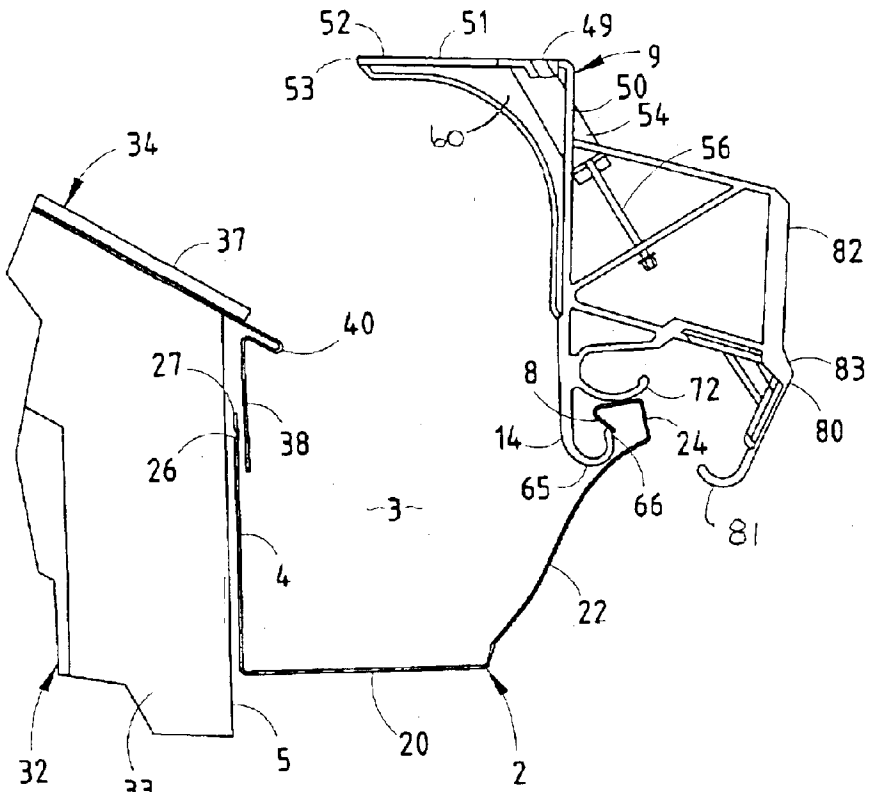
FIG. 7 is a side elevational view of the mounting bracket having a nose portion shown before attachment under an end flange portion of the gutter.

The illustrated guard 1 is preferably installed on gutter 2 in the following fashion. A plurality of mounting brackets 9 are selected for attachment to the roof fascia 5 in a laterally spaced apart relationship along the length of the gutter, generally in between the gutter hangers 45. In one working embodiment of gutter guard 1, mounting brackets 9 are spaced around 30 inches apart. Each of the mounting brackets 9 is attached to gutter 2 in the manner shown in FIGS. 7 and 8, by first positioning the nose 14 of mounting bracket 9 against the end flange 8 of gutter front lip 6, with mounting bracket 9 oriented so that the vertical leg 51 of L-shaped member 49 is disposed along a generally horizontal plane, as shown in FIG. 7. The distance between the outermost portion 65 and free edge 66 on the nose 14 of mounting bracket 9 is greater than the gap formed between the free edge of end flange 8 and the adjacent interior surface of gutter medial portion 22, as shown in FIG. 7, so that nose 14 must be snapped into the interior of the front lip 6 of gutter 2 by forward motion of mounting bracket 7, as shown in FIG. 8. This ensures positive connection between mounting bracket 9 and gutter 2. After nose 14 has been snapped over the end flange 8 of gutter front lip 6, mounting bracket 9 is then spun or rotated rearwardly along a generally vertical arc about nose 14 toward the rear wall 4 of gutter 2, as shown in FIGS. 9 and 9A. The arc about which mounting bracket 9 is shifted is not in a pure vertical plane, but rather is in a laterally offset plane, so that the mounting bracket is articulated into the skewed orientation within the interior 3 of gutter 2 shown in FIGS. 9, 9A and 10. The laterally shifted articulation of mounting bracket 9 ensures that the vertical leg 51 of mounting bracket 9 clears the protruding edge 40 of drip edge 38. The tapered configuration of nose 14 permits the rearward lateral rotating motion of mounting bracket 9 into the skewed position shown in FIGS. 9A and 10, without deforming or distorting the shape of the front lip 6 of gutter 2. Mounting bracket 9 rotates approximately 90 degrees vertically, so that leg 51 shifts from the generally horizontal orientation shown in FIGS. 7 and 8 to the generally vertical position shown in FIGS. 11 and 12, and rotates around 20–40 degrees horizontally to assume the skewed or angled position shown in FIGS. 9A and 10. In the skewed position shown in FIGS. 9A and 10, the side edge 59 of vertical leg 51 is positioned abutting against the rear wall 4 of gutter 2. From the skewed position shown in FIGS. 9A and 10, the installer then rotates mounting bracket 9 along a generally horizontal plane about nose 14 into a generally perpendicular orientation within the interior 3 of gutter 2, as shown in FIGS. 10–13. The movement of mounting bracket 9 from the orientation shown in FIG. 8 to the perpendicular orientation shown in FIG. 10 positively captures nose 14 in the channel 7 of gutter 2. Furthermore, the flat rear surface 52 of vertical leg 51, including wing 61, ensures that mounting bracket 9 is rotated into the precise perpendicular orientation within the interior of gutter 2, which in turn locates cap retainer 72 relative to the front lip 6 of gutter 2 in a predetermined horizontal or fore-to-aft relationship. The bottom edge 53 of vertical leg 51 is positioned flush, abutting the bottom wall 20 of gutter 2, which not only assists in retaining a precise perpendicular relationship between mounting bracket 9 and gutter 2, but also vertically positions mounting bracket 9 within gutter 2, which in turn locates cap retainer 72 vertically relative to the front lip 6 of gutter 2. The self-leveling and self-aligning features of mounting bracket 9 within the interior 3 of gutter 2 greatly reduce installation time and effort. Also, when guard 1 incorporates an imperforate type of cap 12, these features also serve to precisely retain gutter cap 12 in a predetermined edge forward relationship with gutter 2 that maintains a consistent gap to keep out debris and animals, such as rodents, birds, etc., without restricting the flow of water into gutter 2.

After mounting bracket 9 has been shifted into its proper perpendicular relationship within the interior 3 of gutter 2, the installer drives fastener 56 through the rear wall 4 of gutter 2 and into the roof fascia 5. Preferably, fastener 56 has a threaded shank and a sharpened point which forms its own aperture to avoid a separate drilling operation. A power drill or driver is preferably used to rotate fastener 56 into the secured position. In the example shown in FIG. 11, a power driver 108 is provided with a fastener socket 109 connected to power driver 108 by an extension 110. Preferably, fastener 56 has a hex-type head, and is pre-mounted in fastener boss 54, such that the installer simply inserts socket 109 and extension 110 through the access apertures 87–88 in top member 80 and flange 86 so as to connect socket 109 with the head of fastener 56. As fastener 56 is driven into roof fascia 5, the arm 57 on mounting bracket 9 abuts the bottom wall 20 of gutter 2 and resists rotation of mounting bracket 9 from its predetermined position.

After each of the mounting brackets 9 have been installed in the manner described hereinabove, cap 12 is attached to the installed mounting brackets 9 in the following fashion. As best illustrated in FIG. 12, the front edge 81 of cap 12 is positioned along the forward portions of mounting brackets 9, such that the ledge formed by flanges 102–104 is positioned behind the free edges 73 of cap retainer 72. Cap 12 is then rotated rearwardly, with the rearwardmost section 95 being inserted beneath the second course of roof shingles 37*a*, and then shifting the cap toward the roof, so that the cap ledge is captured by cap retainer 72, and the forward portion 94 of cap 12 is received over the front edge 81 of mounting bracket top member 80, as shown in FIG. 13. Preferably, fasteners 114 are then driven vertically through cap 12 into the rear portion 82 of mounting brackets 9 to positively attach cap 12 to mounting brackets 9. Because the aperture through which fasteners 114 are inserted is positioned directly above the interior 3 of gutter 2, the fasteners need not be watertight or otherwise sealed.

Guard 1 is self-supporting, and can be easily and quickly attached to an existing rain gutter 2. The unique mounting brackets 9 anchor the guard solely through the roof fascia 5, and do not penetrate or damage the roof shingles. Furthermore, the mounting brackets precisely retain the cap in a predetermined edge forward relationship with the gutter that maintains a consistent gap to keep out debris and animals, without restricting the flow of rainwater into the gutter.

In the foregoing description, it will be readily appreciated by those skilled in the art that modifications may be made to the invention without departing from the concepts disclosed herein. Such modifications are to be considered as included in the following claims, unless these claims by their language expressly state otherwise.

We claim:

1. A guard for conventional rain gutters having a generally trough-shaped interior, a rear wall extending along a roof fascia, and a front lip with a channel and an end flange extending outwardly away from the rear wall, comprising:

a cap having a rearward portion thereof shaped to extend along an associated roof, a medial portion thereof shaped to extend over the interior of the gutter and a forward portion thereof shaped to extend adjacent to the front lip of the gutter; and a mounting bracket having a rearward portion thereof adapted for abutment with the rear wall of the gutter, an upper portion thereof supporting said cap to deflect debris from the interior of the gutter, and a forward portion thereof having a hook-shaped nose means for insertion under the end flange of the gutter such that said mounting bracket is rotated rearwardly along a generally vertical arc about said nose means toward the rear wall of the gutter, and shifted laterally into a skewed orientation within the interior of the gutter, and subsequently pivoted laterally along a generally horizontal plane about said nose means into a generally perpendicular orientation within the interior of the gutter to retain said nose means in the channel of the gutter, and facilitate attachment of the rearward portion of said mounting bracket to the rear wall of the gutter and the roof fascia.

2. A guard as set forth in claim 1, wherein:

said nose means has a predetermined width which tapers inwardly to an outermost portion thereof to facilitate rotation of said mounting bracket into said perpendicular orientation within the interior of the gutter without distorting the front lip of the gutter.

3. A guard as set forth in claim 2, wherein:

said mounting bracket includes a generally L-shaped member with a vertical leg defining said rearward portion of said bracket; and said vertical leg includes a generally flat rear surface configured to abut the rear wall of the gutter in a flush relationship to positively position said mounting bracket in said perpendicular orientation within the interior of the gutter.

4. A guard as set forth in claim 3, wherein:

said vertical leg of said mounting bracket includes a generally flat bottom edge configured to abut a bottom wall of the gutter in a flush relationship to positively position said mounting bracket vertically within the interior of the gutter.

5. A guard as set forth in claim 4, including:

a fastener extending through said vertical leg of said mounting bracket and the rear wall of the gutter and into the roof fascia to securely retain said mounting bracket in place.

6. A guard as set forth in claim 5, wherein:

said vertical leg of said mounting bracket includes an arm extending laterally from said bottom edge of said vertical leg for abuttingly engaging the bottom wall of the gutter to resist rotation of said mounting bracket during installation of said fastener.

7. A guard as set forth in claim 6, wherein:

said nose means is shaped to be snapped over the end flange of the gutter to ensure positive interconnection of said mounting bracket and the gutter.

8. A guard as set forth in claim 7, wherein:

said nose means is shaped for close reception in the channel of the front lip of the gutter to ensure secure interconnection of said mounting bracket and the gutter.

9. A guard as set forth in claim 8, wherein:

said L-shaped member includes a horizontal leg oriented in a generally perpendicular relationship with said vertical leg, and having said nose means disposed on a terminal portion thereof.

10. A guard as set forth in claim 9, wherein:

said mounting bracket includes an inclined top member connected with and disposed generally above said L-shaped member, and defining said upper portion of said mounting bracket.

11. A guard as set forth in claim 10, wherein:

said top member includes a downwardly curved front edge to support said forward portion of said cap.

12. A guard as set forth in claim 11, wherein:

said top member is connected with said L-shaped member by angled flanges extending generally vertically therebetween.

13. A guard as set forth in claim 12, wherein:

said mounting bracket includes an angled fastener boss extending between said vertical leg and said horizontal leg of said L-shaped member, and having a central opening through which said fastener is received.

14. A guard as set forth in claim 13, wherein:

said mounting bracket is configured to be attached to the rear wall of the gutter and the roof fascia with only one said fastener for ease of installation.

15. A guard as set forth in claim 14, wherein:

said top member and said angled flanges include access apertures to facilitate installation of said fastener.

16. A guard as set forth in claim 15, wherein:

said cap comprises an imperforate sheet wherein said medial portion is inclined downwardly at a predetermined angle, and said forward portion is generally C-shaped and positioned forwardly of the front lip of the gutter to sweep water into the interior of the gutter and deflect debris.

17. A guard as set forth in claim 16, wherein:

said mounting bracket includes a hook-shaped cap retainer; and said cap includes a retainer flange extending along said forward edge thereof, and configured to be received in said cap retainer to interconnect said cap with said mounting bracket.

18. A guard as set forth in claim 17, wherein:

said retainer flange is configured to be pivoted into said cap retainer and positively captured therein.

19. A guard as set forth in claim 18, wherein:

said rearward portion of said cap is shaped for insertion under adjacent roof shingles.

20. A guard as set forth in claim 19, wherein:

said guard is supported solely by the roof fascia through said mounting bracket and said fastener, such that said guard does not penetrate or damage the roof shingles.

21. A guard as set forth in claim 20, wherein:

said forward portion of said cap is positioned a spaced apart distance above the front lip of the gutter to define a gap of predetermined width through which rainwater is swept into the interior of the gutter.

22. A gutter as set forth in claim 21, wherein:

said rear surface and said bottom edge of said mounting bracket precisely locate said nose means and said forward portion of said cap to consistently maintain said predetermined width of said gap to keep animals and debris from entering the gutter without restricting the flow of rainwater into the interior of the gutter.

23. A guard as set forth in claim 1, wherein:

said rearward portion of said mounting bracket includes a generally flat rear surface configured to abut the rear wall of the gutter in a flush relationship to positively position said mounting bracket in said perpendicular orientation within the interior of the gutter.

24. A guard as set forth in claim 1, wherein:

said rearward portion of said mounting bracket includes a generally flat bottom edge configured to abut a bottom wall of the gutter in a flush relationship to positively position said mounting bracket vertically within the interior of the gutter.

25. A guard as set forth in claim 1, including:

a fastener extending through said rearward portion of said mounting bracket and the rear wall of the gutter and into the roof fascia to securely retain said mounting bracket in place.

26. A guard as set forth in claim 1, wherein:

said rearward portion of said mounting bracket includes an arm extending laterally from a bottom edge thereof for abuttingly engaging a bottom wall of the gutter to resist rotation of said mounting bracket during installation.

27. A guard as set forth in claim 1, wherein:

said nose means is shaped to be snapped over the end flange of the gutter to ensure positive interconnection of said mounting bracket and the gutter.

28. A guard as set forth in claim 1, wherein:

said nose means is shaped for close reception in the channel of the front lip of the gutter to ensure secure interconnection of said mounting bracket and the gutter.

29. A guard as set forth in claim 1, wherein:

said mounting bracket includes an inclined top member defining said upper portion of said mounting bracket.

30. A guard as set forth in claim 1, wherein:

said mounting bracket includes an angled fastener boss disposed in said rearward portion thereof having a central opening for receiving a fastener therethrough.

31. A guard as set forth in claim 1, wherein:

said mounting bracket is configured to be attached to the rear wall of the gutter and the roof fascia with only one fastener for ease of installation.

32. A guard as set forth in claim 1, wherein:

said cap comprises an imperforate sheet wherein said medial portion is inclined downwardly at a predetermined angle, and said forward portion is generally C-shaped and positioned forwardly of the front lip of the gutter to sweep water into the interior of the gutter and deflect debris.

33. A guard as set forth in claim 1, wherein:

said mounting bracket includes a hook-shaped cap retainer; and said cap includes a retainer flange extending along said forward edge thereof, and configured to be received in said cap retainer to interconnect said cap with said mounting bracket.

34. A guard as set forth in claim 1, wherein:

said rearward portion of said cap is shaped for insertion under adjacent roof shingles.

35. A guard as set forth in claim 1, wherein:

said guard is supported solely by the roof fascia through said mounting bracket, such that said guard does not penetrate or damage adjacent roof shingles.

36. A guard as set forth in claim 1, wherein:

said forward portion of said cap is positioned a spaced apart distance above the front lip of the gutter to define a gap of predetermined width through which rainwater is swept into the interior of the gutter; and said rear surface and said bottom edge of said mounting bracket precisely locate said nose means and said forward portion of said cap to consistently maintain said predetermined width of said gap to keep animals and debris from entering the gutter without restricting the flow of rainwater into the interior of the gutter.

37. In a conventional rain gutter having a generally trough-shaped interior, a rear wall extending along a roof fascia, and a front lip with a channel and an end flange extending outwardly away from said rear wall, the improvement of a guard, comprising:

a cap having a rearward portion thereof shaped to extend along an associated roof, a medial portion thereof extending over the interior of said gutter, and a forward portion thereof extending adjacent the front lip of said gutter; and a mounting bracket having a rearward portion thereof abutting the rear wall of said gutter, an upper portion thereof supporting said cap to deflect debris from the interior of said gutter, and a forward portion thereof having a hook-shaped nose means for insertion under the end flange of said gutter such that said mounting bracket is rotated rearwardly along a generally vertical arc about said nose means toward the rear wall of said gutter, and shifted laterally into a skewed orientation within the interior of said gutter, and subsequently pivoted laterally along a generally horizontal plane about said nose means into a generally perpendicular orientation within the interior of said gutter to retain said nose means in the channel of said gutter, and facilitate attachment of the rearward portion of said mounting bracket to the rear wall of said gutter and the roof fascia.

38. A guard as set forth in claim 37, wherein:

said nose means has a predetermined width which tapers inwardly to an outermost portion thereof to facilitate rotation of said mounting bracket into said perpendicular orientation within the interior of said gutter without distorting the front lip of said gutter.

39. A guard as set forth in claim 37, wherein:

said mounting bracket includes a generally flat rear surface abutting the rear wall of said gutter in a flush relationship to positively position said bracket in said perpendicular orientation within the interior of said gutter, and a generally flat bottom edge abutting a bottom wall of said gutter in a flush relationship to positively position said mounting bracket vertically within the interior of said gutter.

40. A guard as set forth in claim 39, wherein:

said cap comprises an imperforate sheet wherein said medial portion is inclined downwardly at a predetermined angle, and said forward portion is generally C-shaped and positioned forwardly of the front lip of said gutter to sweep water into the interior of said gutter and deflect debris.

41. A guard as set forth in claim 40, wherein:

said forward portion of said cap is positioned a spaced apart distance above the front lip of said gutter to define a gap of predetermined width through which rainwater is swept into the interior of the gutter; and said rear surface and said bottom edge of said mounting bracket precisely locate said nose means and said forward portion of said cap to consistently maintain said predetermined width of said gap to keep animals and debris from entering the gutter without restricting the flow of rainwater into the interior of the gutter.

42. A guard as set forth in claim 41, wherein:

said rearward portion of said cap is shaped for insertion under shingles extending along the roof fascia.

43. A guard as set forth in claim 42, wherein:

said guard is supported solely by the roof fascia through said mounting bracket and said fastener, such that said guard does not penetrate or damage the roof shingles.

44. A guard as set forth in claim 43, including:

a single fastener extending through the rearward portion of said mounting bracket and the rear wall of said gutter and into the roof fascia to securely retain said mounting bracket in place.

45. A mounting bracket for rain gutter guards having a deflector extending over a conventional gutter with a generally trough-shaped interior, a rear wall extending along a roof fascia, and a front lip with a channel and an end flange extending outwardly away from the rear wall, said mounting bracket comprising:

a rearward portion thereof adapted for abutment with the rear wall of the gutter, an upper portion thereof shaped for supporting the deflector to deflect debris from the interior of the gutter, and a forward portion thereof having a hook-shaped nose means for insertion under the end flange of the gutter such that said mounting bracket is rotated rearwardly along a generally vertical arc about said nose toward the rear wall of the gutter, and shifted laterally into a skewed orientation within the interior of the gutter to positively capture said nose means in the channel of the gutter, and subsequently pivoted laterally along a generally horizontal plane about said nose means into a generally perpendicular orientation within the interior of the gutter to retain said nose means in the channel of the gutter, and facilitate attachment of the rearward portion of said mounting bracket to the rear wall of the gutter and the roof fascia.

46. A mounting bracket as set forth in claim 45, wherein:

said nose means has a predetermined width which tapers inwardly to an outermost portion thereof to facilitate rotation of said mounting bracket into said perpendicular orientation within the interior of the gutter without distorting the front lip of the gutter.

47. A mounting bracket as set forth in claim 46, wherein:

said mounting bracket includes a generally L-shaped member with a vertical leg defining said rearward portion of said bracket; and said vertical leg includes a generally flat rear surface configured to abut the rear wall of the gutter in a flush relationship to positively position said bracket in said perpendicular orientation within the interior of the gutter.

48. A mounting bracket as set forth in claim 47, wherein:

said vertical leg of said mounting bracket includes a generally flat bottom edge configured to abut a bottom wall of the gutter in a flush relationship to positively position said mounting bracket vertically within the interior of the gutter.

49. A mounting bracket as set forth in claim 48, wherein:

said vertical leg of said mounting bracket includes an arm extending laterally from said bottom edge of said vertical leg for abuttingly engaging the bottom wall of the gutter to resist rotation of said mounting bracket during installation.

50. A mounting bracket as set forth in claim 49, wherein:

said nose means is shaped to be snapped over the end flange of the gutter to ensure positive interconnection of said mounting bracket and the gutter.

51. A mounting bracket as set forth in claim 50, wherein:

said nose means is shaped for close reception in the channel of the front lip of the gutter to ensure secure interconnection of said mounting bracket and the gutter.

52. A mounting bracket as set forth in claim 51, wherein:

said L-shaped member includes a horizontal leg oriented in a generally perpendicular relationship with said vertical leg, and having said nose disposed on a terminal portion thereof.

53. A mounting bracket as set forth in claim 52, wherein:

said mounting bracket includes an inclined top member connected with and disposed generally above said L-shaped member, and defining said upper portion of said mounting bracket.

54. A mounting bracket as set forth in claim 53, wherein:

said top member includes a downwardly curved front edge to support the forward portion of the deflector.

55. A mounting bracket as set forth in claim 54, wherein:

said top member is connected with said L-shaped member by angled flanges extending generally vertically therebetween.

56. A mounting bracket as set forth in claim 55, wherein:

said mounting bracket includes an angled fastener boss extending between said vertical leg and said horizontal leg of said L-shaped member, and having a central opening for receiving a fastener therethrough.

57. A mounting bracket as set forth in claim 56, wherein:

said top member and said angled flanges include access apertures to facilitate installation of a fastener.

58. A mounting bracket as set forth in claim 57, wherein:

said mounting bracket includes a hook-shaped deflector retainer configured to receive a forward portion of the deflector to retain the same therein.

59. A mounting bracket as set forth in claim 58, including:

a fastener supported in said fastener boss and shaped to be driven through the rear wall of the gutter and into the roof fascia.

60. A method for deflecting debris from rain gutters having a generally trough-shaped interior, a rear wall extending along a roof fascia, and a front lip with a channel and an end flange, comprising:

providing a cap having a rearward portion thereof shaped to extend along an associated roof, a medial portion thereof shaped to extend over the interior of the gutter and a forward portion thereof shaped to extend adjacent to the front lip of the gutter;

providing a mounting bracket having a rearward portion thereof shaped to abut the rear wall of the gutter, an upper portion thereof shaped to support the cap to deflect debris from the interior of the gutter, and a forward portion thereof having a hook-shaped nose;

inserting the nose of the mounting bracket under the end flange of the gutter;

rotating the mounting bracket rearwardly and laterally along a generally vertical arc about the nose toward the rear wall of the gutter into a skewed orientation within the interior of the gutter;

pivoting the mounting bracket along a generally horizontal plane about the nose into a generally perpendicular orientation within the interior of the gutter to retain the nose in the channel of the gutter; and attaching the rearward portion of the mounting bracket to the rear wall of the gutter and the roof fascia.

61. A method as set forth in claim 60, wherein:

said mounting bracket providing step includes forming a generally flat surface on the rearward portion of the bracket; and including shifting the flat rear surface of the mounting bracket to abut the rear wall of the gutter in a flush relationship to positively position the mounting bracket in the perpendicular orientation within the interior of the gutter.

62. A method as set forth in claim 61, wherein:

said mounting bracket providing step includes forming a generally flat bottom edge on the rearward portion of the mounting bracket; and including shifting the flat bottom edge of the mounting bracket into abutment with the bottom wall of the gutter in a flush relationship to positively position the mounting bracket vertically within the interior of the gutter.

63. A method as set forth in claim 62, wherein:

said attaching step includes inserting a single fastener through the rearward portion of the mounting bracket and the rear wall of the gutter and into the roof fascia to securely retain the mounting bracket in place.

64. A method as set forth in claim 63, wherein:

said inserting step comprises snapping the nose over the end flange of the gutter to ensure positive interconnection of the mounting bracket and the gutter.

65. A method as set forth in claim 60, wherein:

said mounting bracket providing step includes forming a generally flat bottom edge on the rearward portion of the mounting bracket; and including shifting the flat bottom edge of the mounting bracket into abutment with the bottom wall of the gutter in a flush relationship to positively position the mounting bracket vertically within the interior of the gutter.

66. A method as set forth in claim 60, wherein:

said attaching step includes inserting a single fastener through the rearward portion of the mounting bracket and the rear wall of the gutter and into the roof fascia to securely retain the mounting bracket in place.

67. A method as set forth in claim 60, wherein:

said inserting step comprises snapping the nose over the end flange of the gutter to ensure positive interconnection of the mounting bracket and the gutter.

* * * * *